US009822432B2

(12) United States Patent
Kim et al.

(10) Patent No.: US 9,822,432 B2
(45) Date of Patent: Nov. 21, 2017

(54) MAGNESIUM ALLOY WITH EXCELLENT IGNITION RESISTANCE AND MECHANICAL PROPERTIES, AND METHOD OF MANUFACTURING THE SAME

(75) Inventors: Young Min Kim, Changwon (KR); Ha Sik Kim, Changwon (KR); Bong Sun You, Changwon (KR); Chang Dong Yim, Changwon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 0 days.

(21) Appl. No.: 13/511,015

(22) PCT Filed: Oct. 4, 2011

(86) PCT No.: PCT/KR2011/007299
§ 371 (c)(1),
(2), (4) Date: May 21, 2012

(87) PCT Pub. No.: WO2012/096432
PCT Pub. Date: Jul. 19, 2012

(65) Prior Publication Data

US 2013/0280121 A1 Oct. 24, 2013

(30) Foreign Application Priority Data

Jan. 11, 2011 (KR) ..... 10-2011-0002553
Mar. 16, 2011 (KR) ..... 10-2011-0023262

(51) Int. Cl.
*C22C 23/02* (2006.01)
*B22D 21/04* (2006.01)
(Continued)

(52) U.S. Cl.
CPC ..... *C22C 23/02* (2013.01); *B22D 21/04* (2013.01); *B22D 25/00* (2013.01); *C22C 1/02* (2013.01)

(58) Field of Classification Search
CPC ..... C22C 23/02
(Continued)

(56) References Cited

U.S. PATENT DOCUMENTS 3,119,684 A * 1/1964 Foerster ..... C22C 23/00 148/420
4,997,622 A * 3/1991 Regazzoni et al. ..... 420/407
(Continued)

FOREIGN PATENT DOCUMENTS

CN 101037753 A 9/2007
DE 102006057719 A1 * 7/2007 ..... C22C 23/02
(Continued)

OTHER PUBLICATIONS

Computer-Generated Translation of JP 2002-129272 (Ishida et al.), published in Japanese on May 9, 2002.*
(Continued)

*Primary Examiner* — Scott Kastler
*Assistant Examiner* — Vanessa A Luk
(74) *Attorney, Agent, or Firm* — Lex IP Meister, PLLC

(57) ABSTRACT

A magnesium alloy that forms a stable protective film on the surface of molten metal, having excellent ignition resistance restricting natural ignition of a chip thereof as well as having excellent strength and ductility, so that the Mg alloy can be melted and cast in the air or a common inert atmosphere. The magnesium alloy includes, by weight, 7.0% or greater but less than 11% of Al, 0.05% to 2.0% of Ca, 0.05% to 2.0% of Y, greater than 0% but not greater than 6.0% of Zn, and the balance of Mg, and the other unavoidable impurities. The total content of the Ca and the Y is equal to or greater than
(Continued)

0.1% but less than 2.5% of the total weight of the magnesium alloy.

2 Claims, 3 Drawing Sheets

(51) Int. Cl.
*B22D 25/00* (2006.01)
*C22C 1/02* (2006.01)

(58) Field of Classification Search
USPC ..... 148/420; 420/407–410
See application file for complete search history.

(56) References Cited

U.S. PATENT DOCUMENTS

| | | | | | |
|---|---|---|---|---|---|
| 5,073,207 | A * | 12/1991 | Faure et al. | ..... | 148/667 |
| 5,078,962 | A * | 1/1992 | Regazzoni et al. | ..... | 420/402 |
| 5,811,058 | A * | 9/1998 | Baba et al. | ..... | 420/410 |
| 6,818,075 | B1 * | 11/2004 | Park | ..... | C22C 23/06 148/275 |
| 2005/0095166 | A1 * | 5/2005 | Saikawa | ..... | 420/407 |
| 2005/0150577 | A1 * | 7/2005 | Suzuki et al. | ..... | 148/420 |
| 2009/0053555 | A1 * | 2/2009 | Nose et al. | ..... | 428/653 |
| 2010/0054985 | A1 | 3/2010 | Dieringa | | |
| 2010/0254848 | A1 * | 10/2010 | Inoue et al. | ..... | 420/408 |
| 2012/0059455 | A1 * | 3/2012 | Weber | ..... | A61L 31/022 623/1.42 |
| 2012/0100035 | A1 * | 4/2012 | Oishi et al. | ..... | 420/404 |
| 2012/0107171 | A1 * | 5/2012 | Kitamura et al. | ..... | 420/404 |

FOREIGN PATENT DOCUMENTS

| | | | | |
|---|---|---|---|---|
| EP | 1308530 | | 5/2003 | |
| EP | 1775037 | | 4/2007 | |
| GB | 2340129 | | 2/2000 | |
| JP | 2002-129272 | | 5/2002 | |
| JP | 2006-257478 | * | 9/2006 | ..... C22C 23/02 |
| JP | 2006257478 | | 9/2006 | |
| JP | 2007-031789 | | 2/2007 | |
| JP | 2007-031789 A | | 2/2007 | |
| JP | 2010-036221 | | 2/2010 | |
| KR | 10-2006-0110292 | | 10/2006 | |

OTHER PUBLICATIONS

Professional Translation of CN 101037753A to Wang et al., published in Chinese on Sep. 19, 2007.*

Computer-Generated Translation of JP 2007-031789A (Suzuki et al.), published originally in the Japanese language on Feb. 8, 2007 (Feb. 8, 2007).*

Seong-Ho Ha, Jin-Kyu Lee, Shae K. Kim, "Effect of CaO on Oxidation Resistance and Microstructure of Pure Mg," Materials Transactions, Special Issue on Platform Science and Technology for Advanced Magnesium Alloys, IV, The Japan Institute of Metals, vol. 49, No. 5, 2008, pp. 1081-1083.*

Bong-Sun You, Moon-Hoe Kim, Won-Wook Park, In-Sang Chung, "Effects of Al and Y Additions on the Oxidation Behavior of Mg—Ca Base Molten Alloys," Materials Science Forum, vols. 419-422, pp. 581-586, available online Mar 15, 2003.*

Canadian Office Action, "Magnesium Alloy With Excellent Ignition Resistance and Mechanical Properties, and Method of Manufacturing the Same", Canadian Intellectual Property Office, Mar. 13, 2015, Application No. 2,777,830.

European Office Action, "Magnesium Alloy Having Excellent Ignition Resistance and Mechanical Properties, and Method for Manufacturing Same", European Patent Office, Feb. 23, 2015, Application No. 11842453.0.

Cheng S L et al: "Effect of Ca and Y additions on oxidation behavior of AZ91 alloy at elevated temperatures", Transactions of Nonferrous Metals Society of China, vol. 19, No. 2, Apr. 1, 2009 (Apr. 1, 2009), pp. 299-304.

Wang F et al: "Effects of combined addition of Y and Ca on microstructure and mechanical properties of die casting AZ91 alloy", Transactions of Nonferrous Metals Society of China, vol. 20, Jul. 1, 2010 (Jul. 1, 2010), pp. s311-s317.

Bak S H et al: "Effect of Y and Y2O3 on oxidation of AZ91D Mg alloys between 400 °C and 500 °C", Transactions of Nonferrous Metals Society of China, vol. 19, No. 4, Aug. 1, 2009 (Aug. 1, 2009), pp. 871-874.

Zhang J S et al: "Effect of Ca on crystallization of Mg-based master alloy containing spherical quasicrystal", Transactions of Nonferrous Metals Society of China, vol. 17, No. 2, Apr. 1, 2007 (Apr. 1, 2007), pp. 273-279.

* cited by examiner

MAGNESIUM ALLOY WITH EXCELLENT IGNITION RESISTANCE AND MECHANICAL PROPERTIES, AND METHOD OF MANUFACTURING THE SAME

TECHNICAL FIELD

The present invention relates to a magnesium alloy having excellent ignition resistance or nonflammability, and more particularly, to a magnesium alloy that can be melted and cast in the air as well as in a common inert atmosphere due to the presence of a stable protective film formed on the surface of the molten metal, has excellent ignition resistance or nonflammability in order to prevent spontaneous ignition of chips, and is excellent in both strength and ductility, and a method of manufacturing the same.

BACKGROUND ART

Magnesium alloys, which have a high specific strength, are the lightest of alloys, are applicable in a variety of casting and machining processes, and have a wide range of application, and are thereby used in almost all fields in which light weight is required, such as parts for vehicles and electronic parts. However, magnesium (Mg) is a metallic element that has a low electrochemical potential and is very active. Mg still has limitations in terms of the stability and reliability of the material, since it undergoes a strong reaction when it comes into contact with oxygen or water, and sometimes causes fires. Therefore, the fields in which Mg can be applied are still limited compared to its potential applicability. In particular, it cannot be used in applications in which safety is important.

Because of this activity of Mg alloys, it is necessary to create an inert atmosphere using an inert mixture gas, such as a flux or $CO_2$+$SF_6$. Since the flux that is used in melting and refining is a chlorinated substance, there is a problem in that chlorine atoms reside inside a material, thereby significantly decreasing corrosion resistance when the conditions for processing the molten metal are not fulfilled. In order to solve this problem, it is effective to perform melting and casting in an atmosphere in which $SF_6$, $CO_2$ and air are mixed, instead of using the flux. However, $SF_6$ is classified as a greenhouse gas, the global-warming potential (GWP) of which is 24 times that of $CO_2$, so that the use thereof is expected to be regulated in the future time.

In order to more fundamentally solve this problem, studies for improving the oxidation resistance of Mg alloys, in particular, studies intended to increase the ignition temperature of Mg alloys by adding Ca, Be or rare-earth metals, have been carried out. Traditionally, Ca has been a main choice among the alloying elements that are added to Mg alloys that are oxidation resistant because Ca is cheaper than other rare-earth metals, is nontoxic, and greatly increases the ignition temperature in consideration of the amount that is added.

According to previous studies on magnesium alloys that contain Ca, it is known that the ignition temperature increases by about 250° C. when 3 wt % or greater of Ca is added. Therefore, the ignition temperature should be maintained as higher as possible in order to stably cast Mg alloys, which contain Al of 7 to 11 wt %, for example, without a shielding gas. To this end, it is preferred that a great amount of Ca be added to Mg alloys.

However, when a great amount of Ca is added particularly in an amount greater than 2 wt %, the tensile properties of Mg alloys are generally degraded, with the decrease in elongation being particularly significant. This is because a great quantity of coarse and brittle eutectic phases is formed, thereby resulting in cracks. In addition, when Ca is added in an amount greater than 2 wt %, there occurs a problem of die sticking, making it difficult to manufacture a product. Therefore, there is the demand for the development of a magnesium alloy that does not cause other problems such as sticking or the like while satisfying both the ignition resistance and the tensile properties.

DISCLOSURE

Technical Problem

Therefore, an object of the present invention is to provide a magnesium alloy that is intended to solve the foregoing problem of the related art.

Specifically, an object of the present invention is to provide a magnesium alloy that contains Ca and Y therein, and more particularly, has excellent ignition resistance and excellent tensile properties.

In addition, an object of the present invention is to provide a magnesium alloy that enables an environment-friendly manufacturing process, which uses a minimum amount of Ca and Y and does not use a protective gas such as $SF_6$, which is an environmental pollutant.

Technical Solution

In order to realize the foregoing object, according to the present invention, provided is a magnesium (Mg) alloy, which is manufactured by melt casting. The Mg alloy includes, by weight, 7.0% or greater but less than 9.5% of Al, 0.05% to 2.0% of Ca, 0.05% to 2.0% of Y, greater than 0% but not greater than 6.0% of Zn, and the balance of Mg, and the other unavoidable impurities. The total content of the Ca and the Y is equal to or greater than 0.1% but less than 2.5% of the total weight of the magnesium alloy.

In addition, it is preferable that the content of the Ca range, by weight, from 0.1% to 1.0%.

Furthermore, it is preferable that the content of the Y range, by weight, from 0.1% to 1.0%.

In addition, it is preferable that the contents of the Ca and the Y range from 0.2% to 1.5% of a total weight of the magnesium alloy.

Furthermore, it is preferable that the magnesium alloy further include, by weight, greater than 0% but not greater than 1.0% of Mn.

According to the present invention, provided is a method of manufacturing a magnesium alloy. The method includes the following steps of: forming a magnesium alloy molten metal, which contains Mg, Al and Zn; adding raw materials of Ca and Y into the magnesium alloy molten metal; producing a magnesium alloy cast material from the magnesium alloy molten metal, in which the raw materials of Ca and Y are added, using a certain casting method. A magnesium alloy produced by the above process includes, by weight, 7.0% or greater but less than 9.5% of Al, 0.05% to 2.0% of Ca, 0.05% to 2.0% of Y, greater than 0% but not greater than 6.0% of Zn, the balance of Mg, and the other unavoidable impurities.

According to the present invention, provided is a method of manufacturing a magnesium alloy. The method includes the following steps of: forming a magnesium alloy molten metal, which contains Mg, Al and Zn; forming a master alloy ingot, which contains Mg, Al, Zn, Ca and Y, and is soluble at 750° C. or lower; inputting the master alloy ingot, which is soluble at 750° C. or lower, into the magnesium alloy molten metal; and producing a magnesium alloy cast material from the molten metal, which contains the master alloy ingot, using a certain casting method. A magnesium alloy produced by the above process includes, by weight, 7.0% or greater but less than 9.5% of Al, 0.05% to 2.0% of Ca, 0.05% to 2.0% of Y, greater than 0% but not greater than 6.0% of Zn, the balance of Mg, and the other unavoidable impurities.

In addition, it is preferable that the master alloy ingot, which contains Mg, Al, Zn, Ca and Y, is soluble at 750° C. or lower, and is input into the magnesium alloy molten metal at a temperature lower than 750° C.

According to the present invention, provided is a method of manufacturing a magnesium alloy. The method includes the following steps of: forming a magnesium alloy molten metal, which contains Mg, Al and Zn; adding a Ca compound and a Y compound into the magnesium alloy molten metal; and producing a magnesium alloy cast material from the magnesium alloy molten metal, in which the Ca compound and the Y compound are added, using a certain casting method. A magnesium alloy produced by the above process includes, by weight, 7.0% or greater but less than 9.5% of Al, 0.05% to 2.0% of Ca, 0.05% to 2.0% of Y, greater than 0% but not greater than 6.0% of Zn, the balance of Mg, and the other unavoidable impurities.

In addition, it is preferable that the step of inputting the raw materials of Ca and Y, the master alloy ingot, which contains Mg, Al, Zn, Ca and Y, or the Ca compound and the Y compound into the magnesium alloy molten metal further include the step of periodically stirring the magnesium alloy molten metal.

Furthermore, it is preferable that the casting method be one selected from the group consisting of mold casting, sand casting, gravity casting, squeeze casting, continuous casting, strip casting, die casting, precision casting, spray casting, and semi-solid casting.

In addition, it is preferable that the method further include the step of carrying out hot working on the magnesium alloy cast material produced by the casting method.

The reasons why the content of respective components in the magnesium alloy of the present invention is limited are as follows.

Aluminum (Al)

Al is an element that increases the strength, flowability and solidification range of a magnesium alloy, thereby improving castability. In general, the fraction of the eutectic phase increases in response to an increase in the content of Al that is added. In addition, according to the results of previous studies, it can be appreciated that the ignition resistance increases in response to an increase in the content of Al when Al is added in combination with other alloying elements. Thus, in order to satisfy both the ignition resistance and strength, the content of Al to be added needs to be 7.0 wt % or more. In the meantime, when the content of Al exceeds 11 wt %, which is the maximum solubility limit of Al, tensile properties are degraded due to a coarse $Mg_{17}Al_{12}$ eutectic phase. Therefore, it is preferred that Al is contained in the range of 7.0 wt % to 11 wt %.

Calcium (Ca)

Ca improves the strength and thermal resistance properties of Mg alloys by forming a Mg—Al—Ca intermetallic compound from a Mg—Al-based alloy as well as reducing the oxidation of a molten metal by forming a thin and dense hybrid oxide layer of MgO and CaO on the surface of the molten metal, thereby improving the ignition resistance of the Mg alloy. However, when the content of Ca is less than 0.05 wt %, the effect of the improved ignition resistance is not significant. On the other hand, when the content of Ca is greater than 2 wt %, the castability of the molten metal decreases, hot cracking occurs, die sticking increases, and elongation significantly decreases, which are problematic. Therefore, in the Mg alloy of the present invention, Ca is added in an amount ranging preferably from 0.05 wt % to 2.0 wt %.

Yttrium (Y)

Y is generally used as an element that increases high-temperature creep resistance due to precipitation strengthening, since it originally has a high solubility limit. When Y is added in combination with Ca to the magnesium alloy, the fraction of the coarse Ca-containing eutectic phase decreases. When Y is added in an amount of 0.4 wt % or greater, there is an effect in that $Al_2Y$ particles, which form microscopic grains of a cast material, are formed, thereby improving tensile properties. In addition, an oxide layer of $Y_2O_2$ is formed on the surface of a molten metal to form a mixed layer with MgO and CaO, thereby increasing ignition resistance. When Y is contained in an amount of less than 0.05 wt % in the Mg alloy, an oxide layer is difficult to be stably formed on the surface of the molten metal, so that an increase in the ignition resistance is not much great. When Y is contained in an amount greater than 2 wt %, the price of the Mg alloy rises, and it increases the sensibility to crack due to the coarsening of $Al_2Y$ particles. Therefore, in the Mg alloy of the present invention, Y is included in an amount ranging preferably from 0.05 wt % to 2.0 wt %.

Zinc (Zn)

Zn has an effect of refining grains and increasing strength when added together with Al. In addition, the maximum solubility limit of Zn in the Mg alloy is 6.2 wt %. When an amount of Zn greater than this limit is added, a coarse eutectic phase that is created during casting weakens the mechanical properties of the cast material. Therefore, it is preferred that Zn be added in an amount equal to or less than 6 wt %.

Manganese (Mn)

In the Mg—Al-based alloy, Mn improves corrosion resistance due to its bonding with Fe, which is an impurity element that impedes corrosion resistance, and increases strength by forming an Al—Mn intermetallic compound at a rapid cooling speed. However, when Mn is added in an amount greater than 1.0 wt %, a coarse β-Mn or $Al_8Mn_5$ phase is formed in the Mg alloy, thereby deteriorating the mechanical properties. Therefore, it is preferred that Mn be included in an amount equal to or less than 1.0 wt %.

Other Unavoidable Impurities

The Mg alloy of the present invention may contain impurities that are unavoidably mixed from raw materials thereof or during the process of manufacture. Among the impurities that can be contained in the Mg alloy of the invention, iron (Fe), silicon (Si) and nickel (Ni) are components that particularly worsen the corrosion resistance of the Mg alloy. Therefore, it is preferred that the content of Fe be maintained at 0.004 wt % or less, the content of Si be maintained at 0.04 wt % or less, and the content of Ni be maintained at 0.001 wt % or less.

Total Amount of Ca and Y

It is generally known that when only Ca is separately added, a thin, dense combined oxide layer of MgO/CaO is formed on the surface of a solid or liquid Mg alloy, so that the ignition temperature of the Mg alloy is increased. In contrast, when Ca and Y are added in combination, as will be described later, a dense combined oxide layer of CaO/$Y_2O_3$ is further formed between the oxide layer of MgO/CaO and the surface of a solid or liquid Mg alloy, so that the ignition resistance of the Mg alloy becomes superior to that of a Mg alloy to which Ca or Y is separately added. In addition, when Ca or Y is separately added, an amount of 2 wt % or greater is generally added in order to obtain excellent ignition resistance. In this case, however, there is a problem in that the tensile properties are greatly degraded because a coarse intermetallic compound is formed. In contrast, the addition of Ca and Y in combination can advantageously improve tensile properties by decreasing the fraction and size of the intermetallic compound while obtaining excellent ignition resistance. When Ca and Y are added to the Mg alloy such that the total content thereof is less than 0.1 wt %, the effect of the combined addition of Ca and Y does not appear. This results in a low ignition temperature of 650° C., thereby making it impossible to perform melting in the air or a common inert gas atmosphere. In addition, when the total content of Ca and Y is 2.5 wt % or greater, an increase in the cost of the alloy undesirably results without any advantage related to the additional increase in the ignition temperature, which is caused by the exceeding content. Therefore, in the Mg alloy of the invention, it is preferred that the total content of Ca and Y that are added be in the range preferably equal to or greater than 0.1 wt % and less than 2.5 wt, and more preferably from 0.2 wt % to 1.5 wt %.

Advantageous Effects

The Mg alloy according to the invention forms a dense composite oxide layer that acts as a protective film. Thus the Mg alloy has very excellent oxidation and ignition resistance, can be melted, cast and machined in the air or a common inert atmosphere (Ar or $N_2$), and can reduce the spontaneous ignition of chips that are accumulated during the process of machining.

In addition, the Mg alloy according to the invention is adapted to reduce costs, protect the health of workers, and prevent environmental pollution since it does not use a gas such as $SF_6$.

Furthermore, the Mg alloy according to the invention is applicable as a material for structural components, since its ignition resistance is superior to that of common alloys, with the ignition temperature thereof being equal to or higher than the melting point thereof, and it also has excellent strength and ductility.

Moreover, the Mg alloy according to the invention can be manufactured as a high-strength cast material or the like, which can be practically applied not only to components of mobile electronics, such as mobile phones and notebook computers, but also to next-generation vehicles, high-speed rail systems, urban railways, and the like.

BEST MODE

Figure 1:
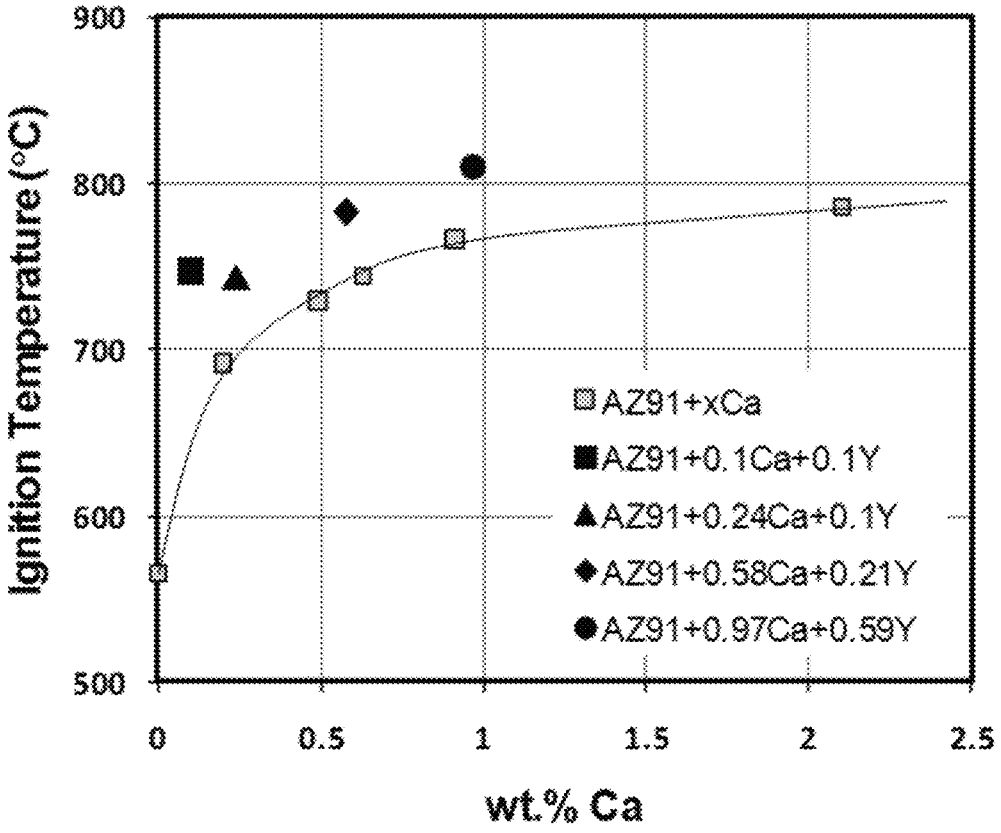
FIG. 1 is a view showing variation in the ignition temperature depending on the amount of Ca and Y that is added in comparative example 2 to comparative example 7 and example to example 6, which are cast according to an exemplary embodiment of the invention.

Reference will now be made in detail to exemplary embodiments of a Mg alloy and a method of manufacturing the same according to the present invention. However, it is to be understood that the following embodiments are illustrative but do not limited the invention.

The method of manufacturing a Mg alloy according to an exemplary embodiment of the invention is as follows.

First, raw materials that include Mg (99.9%), Al (99.9%), Zn (99.99%), Ca (99.9%), Y (99.9%) and selectively Mn (99.9%) were prepared, and were then melted. Then, Mg alloy cast materials having the alloy compositions described in comparative example 1 to comparative example 7 and example 1 to example 6 in Table 1 below were produced from the raw materials using a gravity casting method. Specifically, the temperature of a molten metal was increased up to a temperature between 850° C. and 900° C., so that these elements were completely melted, in order to produce an alloy by directly inputting Ca and Y, which have high melting points of 842° C. and 1525° C., respectively, into the molten metal. After that, the molten metal was gradually cooled down to a casting temperature, and then the Mg alloy cast materials were produced by casting the molten metal.

Alternatively, according to an exemplary embodiment of the invention, it is possible to manufacture a Mg alloy by a variety of methods in addition to the method in which casting is performed after a molten metal is formed by simultaneously melting raw materials including Mg (99.9%), Al (99.9%), Zn (99.99%), Ca (99.9%) and Y (99.9%). In an example, it is possible to first form a Mg alloy molten metal using the raw materials of Mg, Al and Zn or alloys thereof, input the raw materials of Ca and Y, or a Ca compound and a Y compound into the Mg alloy molten metal, and then produce a Mg alloy cast material by a suitable casting method. It is also possible to produce a Mg alloy cast material by preparing a Mg, Al, Zn, Ca and Y alloy (master alloy ingot) of which the contents of Ca and Y are higher than final target values, forming a Mg alloy molten metal using raw materials of Mg, Al and Zn or alloys thereof, and then inputting the master alloy ingot into the Mg alloy molten metal. This method is particularly advantageous in that the master alloy ingot can be input at a temperature that is lower than the temperature at which the raw materials of Ca and Y are directly input into the Mg alloy molten metal, since the melting point of the master alloy ingot is lower than those of the raw materials of Ca and Y. In addition, the formation of a Mg alloy according to the invention can be realized by a variety of methods, and all methods of forming a Mg alloy that are well-known in the art to which the invention belongs are included as part of the invention.

TABLE 1

| | Alloy Symbol | Alloy Composition | | | | |
|---|---|---|---|---|---|---|
| | | Al | Zn | Ca | Y | Mn |
| Comp. Ex. 1 | AZ80 | 7.76 | 0.54 | | | 0.17 |
| Comp. Ex. 2 | AZ91 | 8.51 | 0.65 | 0 | | 0.21 |
| Comp. Ex. 3 | AZ91 + 0.2Ca | 8.89 | 0.76 | 0.20 | | 0.21 |
| Comp. Ex. 4 | AZ91 + 0.5Ca | 8.35 | 0.62 | 0.49 | | 0.22 |
| Comp. Ex. 5 | AZ91 + 0.7Ca | 8.85 | 0.67 | 0.63 | | 0.25 |
| Comp. Ex. 6 | AZ91 + 1.0Ca | 8.08 | 0.60 | 0.91 | | 0.21 |
| Comp. Ex. 7 | AZ91 + 2.0Ca | 8.42 | 0.68 | 2.10 | | 0.21 |
| Example 1 | Alloy 1 | 7.98 | 0.55 | 0.61 | 0.19 | 0.22 |
| Example 2 | Alloy 2 | 7.94 | 0.50 | 0.18 | 0.12 | 0.20 |
| Example 3 | Alloy 3 | 8.68 | 0.65 | 0.58 | 0.21 | 0.21 |
| Example 4 | Alloy 4 | 8.56 | 0.68 | 0.97 | 0.59 | 0.22 |
| Example 5 | Alloy 5 | 8.56 | 0.53 | 0.24 | 0.10 | 0.22 |
| Example 6 | Alloy 6 | 8.63 | 0.72 | 0.10 | 0.10 | 0.20 |

In this embodiment, a graphite crucible was used for induction melting, and a mixture gas of $SF_6$ and $CO_2$ was applied on the upper portion of the molten metal, so that the molten metal did not come into contact with the air, in order to prevent the molten metal from being oxidized before the alloying process was finished. In addition, after the melting was completed, mold casting was performed using a steel mold without a protective gas. A plate-shaped cast material having a width of 100 mm, a length of 150 mm and a thickness of 15 mm was manufactured for a rolling test, a cylindrical billet having a diameter of 80 mm and a length of 150 mm was manufactured for an extrusion test, and a cylindrical billet having a diameter of 55 mm and a length of 100 mm was manufactured for an ignition test of the alloy cast material. Although the Mg alloy was cast by a mold casting method in this embodiment, a variety of casting methods, such as sand casting, gravity casting, squeeze casting, continuous casting, strip casting, die casting, precision casting, spray casting, semi-solid casting, and the like, may also be used. The Mg alloy according to the invention is not necessarily limited to a specific casting method.

Afterwards, the slabs manufactured by selecting some of the alloys that were prepared above were subjected to homogenization heat treatment at 400° C. for 15 hours. In sequence, the materials of comparative example 2 to comparative example 6 and example 4 in Table 1, which were subjected to homogenization heat treatment, were machined into sheet materials having a final thickness of 1 mm via hot working, in which the respective materials were rolled under conditions of a roll temperature of 200° C., a roll diameter of 210 mm, a roll speed of 5.74 mpm, and a reduction ratio of each roll of 30%/pass.

In addition, in comparative example 1 and example 2 in Table 1, rod-shaped extruded materials having a final diameter of 16 mm were manufactured by extruding the billets that were subjected to homogenization heat treatment under conditions including an extrusion speed of 5 m/min, an extrusion ratio of 25:1, and an extrusion temperature of 250° C. The extruded materials had a good surface state.

Although rolling and extrusion were performed after casting and homogenization heat treatment in this embodiment, the materials may be manufactured by a variety of forming methods, such as forging and drawing, without being necessarily limited to a specific forming method.

Measurement of Ignition Temperature of Mg Alloy

Afterwards, in order to measure the ignition temperature of the Mg alloys, chips having a predetermined size were produced by machining the outer portion of the cylindrical billets, which were manufactured above, in conditions including a depth of 0.5 mm, a pitch of 0.1 mm, and a constant speed of 350 rpm. 0.1 g chips that were produced by the foregoing method were heated by loading them at a constant speed into a heating furnace, which was maintained at 1000° C. The temperatures at which a sudden rise in temperature begins during this process were determined as ignition temperatures, and the results are presented in Table 2. Each value of the ignition temperatures presented in Table 2 indicates the mean of values measured by test that was performed at least 5 times on the same composition.

TABLE 2

| | Ignition Temperature (° C.) |
|---|---|
| Comp. Ex. 1 | 583 |
| Comp. Ex. 2 | 565 |
| Comp. Ex. 3 | 692 |
| Comp. Ex. 4 | 729 |
| Comp. Ex. 5 | 744 |
| Comp. Ex. 6 | 767 |
| Comp. Ex. 7 | 786 |
| Example 1 | 742 |
| Example 2 | 714 |
| Example 3 | 783 |
| Example 4 | 810 |
| Example 5 | 743 |
| Example 6 | 747 |

FIG. 1 is a view showing variation in the ignition temperature depending on the content of Ca according to comparative example 2 to comparative example 7 and example 3 to example 6, which were manufactured using the above-described method.

As presented in Table 2 and shown in FIG. 1, the ignition temperature of Mg alloys of comparative example 2 to comparative example 7 suddenly increases as the amount of Ca that is added increases to 1 wt %, and after that, tends to increase at a uniform rate. This is because thin and dense composite oxide films of CaO and MgO formed on the surface of the surface of the solid or liquid alloy acted as a protective film, thereby increasing the ignition temperature.

Figure 2:
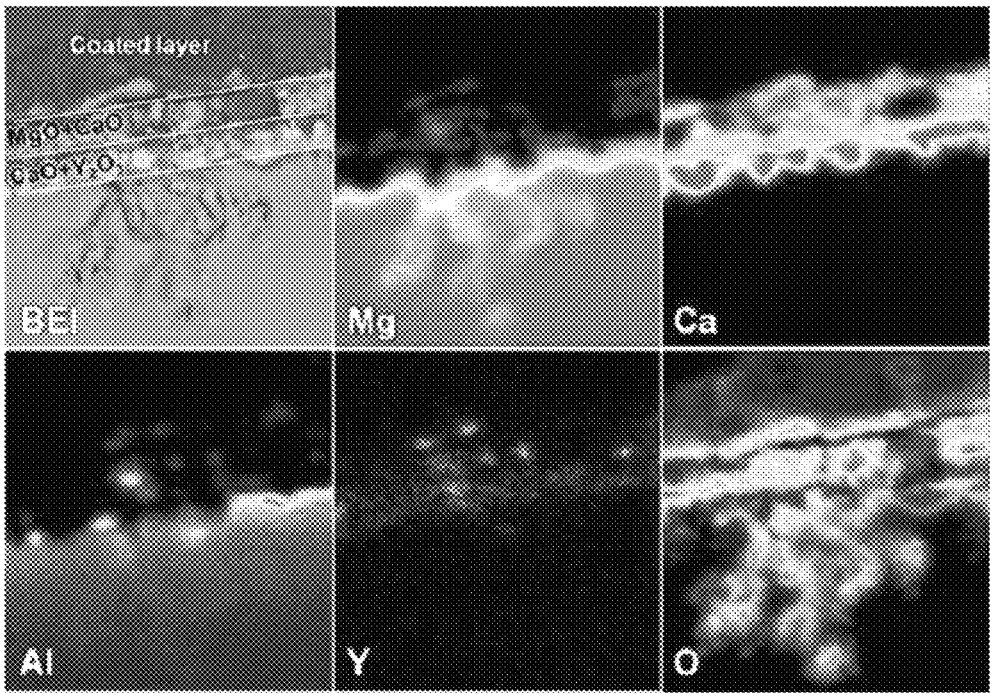
FIG. 2 is a view showing the results of electron probe micro-analysis (EPMA) on an oxide layer on the surface of a molten metal after a magnesium alloy according to example 4, which was cast according to an exemplary embodiment of the invention, was maintained at 670° C. for 10 minutes.
Figure 3:
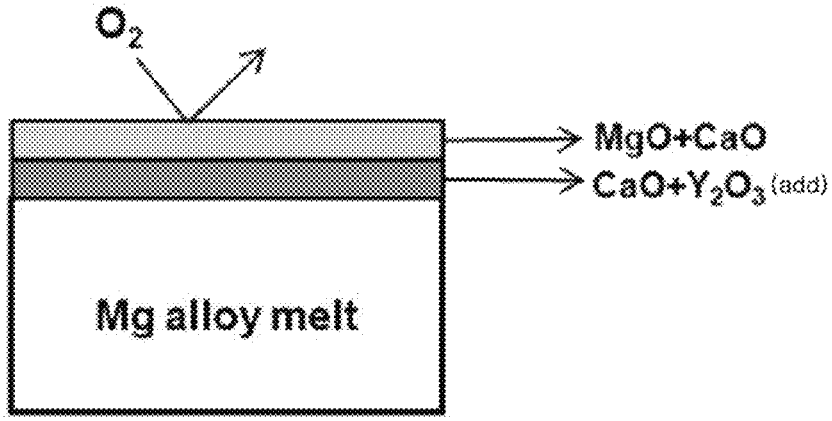
FIG. 3 is a view schematically showing the structure of double composite oxide layers formed on the surface of a solid or liquid phase in an alloy in which Ca and Y are added in combination, the double composite oxide layers serving to block the penetration of external oxygen.

In Table 2, comparing each ignition temperature of example 3 and example 4 with the respective ignition temperature of comparative example 5 and comparative example 6, it can be appreciated that the ignition temperature is much higher when Y was also added to the Mg alloys than when Ca was added alone to the Mg alloys. This is because a mixed layer of CaO and $Y_2O_3$ was formed in the portion that was in contact with molten metal due to the addition of Y, as can be seen from the result of electron probe micro-analysis (EPMA) of FIG. 2, and that this layer was able to effectively reduce the oxygen in the air from penetrating into and reacting with the molten metal. In addition, a mixed layer of CaO and MgO was present in the outer portion of the mixed layer of CaO and $Y_2O_3$. As shown in FIG. 3, these double mixed layers help the molten metal remain more stable by effectively reducing the penetration of oxygen into the molten metal even at high temperatures. In this way, it can be appreciated that the composite oxide layers of CaO and $Y_2O_3$ were formed between the existing oxide layer and the surface of the alloy due to the addition of a small amount of Y to the alloy in which Ca was added, thereby further improving the ignition resistance of the alloy.

In addition, comparing comparative example 4 with example 5, comparative example 6 with example 3, and comparative example 7 with example 4, it can be appreciated that the ignition temperature was higher when Ca and Y were added in combination than when Ca was added alone, even though the total content of Ca and Y was less than the content of Ca. This shows that a more excellent effect can be realized in terms of increasing ignition resistance when Ca and Y are added in combination than when Ca is used alone in order to increase the ignition temperature of the Mg alloy.

Evaluation of Tensile Properties of Mg Alloy

Samples of a rod-shaped extruded material according to the ASTM-E-8M standard, in which the length of a gauge was 25 mm, were manufactured using the Mg alloys of comparative example 1 to comparative example 7 and example 1 to example 6, which were manufactured by the above-described method, and a tensile test was carried out at room temperature under a strain of $1\times10^{-3}$ $s^{-1}$ using a common tensile tester. Alternatively, in the case of rolled materials, rolled sheet materials having a thickness of 1 mm were heat-treated at 250° C. for 30 minutes, and then sub-size sheet-shaped samples in which the length of a gauge was 25 mm, were produced. Tensile test was carried out under the same conditions as for the rod-shaped samples. The results are presented in Table 3.

TABLE 3

| | Yield Strength (MPa) | Tensile Strength (MPa) | Elongation (%) | Remarks |
|---|---|---|---|---|
| Comp. Ex. 1 | 101.7 | 137.3 | 2.3 | Cast material |
| | 167.1 | 295.6 | 25.1 | Extruded material |
| Comp. Ex. 2 | 102.2 | 156.2 | 3.6 | Cast material |
| | 283 | 383 | 11.7 | Rolled material |
| Comp. Ex. 3 | 104.5 | 154.7 | 3.3 | Cast material |
| Comp. Ex. 4 | 100.2 | 160.6 | 3.9 | Cast material |
| Comp. Ex. 5 | 104.3 | 135.3 | 1.9 | Cast material |
| Comp. Ex. 6 | 103.2 | 138.9 | 2.1 | Cast material |
| | 277 | 349 | 8.4 | Rolled material |
| Comp. Ex. 7 | 101.3 | 139.3 | 2.3 | Cast material |
| Example 1 | 97.1 | 138.0 | 2.8 | Cast material |
| Example 2 | 194.5 | 317.9 | 20.1 | Extruded material |
| Example 3 | 102.0 | 153.4 | 3.1 | Cast material |
| Example 4 | 277 | 352 | 8.2 | Rolled material |
| Example 6 | 99.2 | 155.0 | 3.1 | Cast material |

Figure 4:
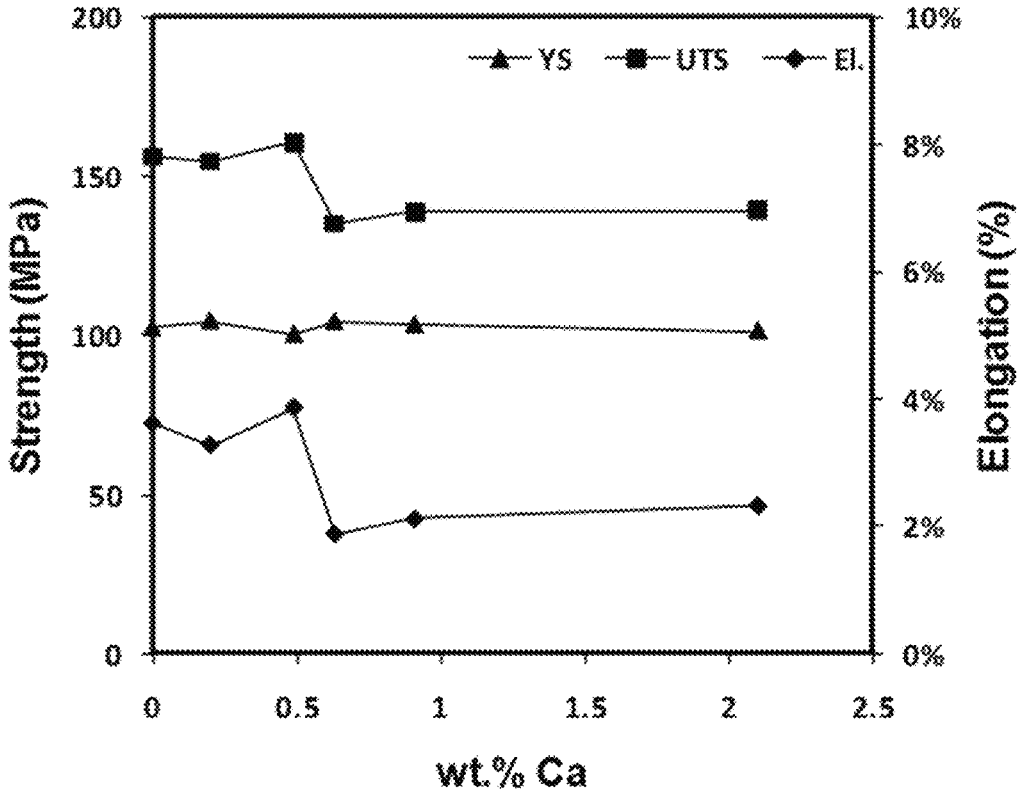
FIG. 4 is a view showing variation in yield strength, tensile strength and elongation depending on the amount of Ca that is added in comparative example 2 to comparative example 7, which are cast according to an exemplary embodiment of the invention.

As shown in FIG. 4, comparing the tensile properties of the cast materials of comparative example 2 to comparative example 7, it can be appreciated that all of the yield strength, the tensile strength and the elongation were increased due to minute effects caused by the addition of Ca as the amount of Ca that was added was increased to 0.5 wt % but were decreased when the amount of Ca that was added was 0.7 wt % or greater. In particular, the elongation of the alloy in which Ca was added in an amount of 0.7 wt % or greater decreased to be smaller than the elongation of comparative example 2 in which Ca was not added. In order to ensure safety in the case of melting in the condition of being exposed to the air and chip machining, an increase in the ignition temperature is essential. For this purpose, at least 1 wt % or greater of Ca must be added. However, in this case, a sudden decrease in the elongation is problematic.

However, as presented in Table 2, comparing comparative example 5 and comparative example 3, it can be appreciated that the tensile strength and elongation of the cast materials were increased when 0.2 wt % of Y was added, if Ca was used in similar contents of 0.63 wt % and 0.58 wt %. This means that the addition of Y can greatly increase the ignition temperature without inducing deterioration in the tensile properties. In fact, the ignition temperature of example 3 in which 0.2 wt % of Y was added was 783° C., increased about 40° C. from the ignition temperature of example 5. This is similar to the ignition temperature of comparative example 7 in which 2.1 wt % of Ca was added. Therefore, the alloy in which 0.58 wt % of Ca and 0.21 wt % of Y are added in combination can have ignition resistance that is the same as that of an alloy in which 2.1 wt % of Ca is added alone as well as tensile properties that are similar to the tensile properties of an ally in which Ca is not added, which are about in the middle of the tensile properties of an alloy in which 0.49 wt % of Ca is added alone and the tensile properties of an alloy in which 0.63 wt % of Ca is added alone.

In addition, comparing comparative example 6 and example 4, it can be appreciated that the tensile properties of the rolled material in the alloy in which the content of Ca was about 1 wt % as in the above were not substantially influenced by the addition of 0.59 wt % of Y. However, due to the addition of Y, the ignition temperature of example 4 was 810° C., which was about 43° C. higher than that of comparative 6. This is also higher than the ignition temperature of comparative example 7 in which 2.1 wt % of Ca was added. Therefore, also for the rolled materials, it can be appreciated that the ignition temperature of the rolled material can also be greatly increased without the decrease in the tensile properties, due to the addition of Y.

As presented in Table 2 and Table 3, comparing comparative example 1 and example 1, it can be appreciated that, even in the alloys in which the respective contents of Al and Zn were decreased to 8 wt % and 0.55 wt %, when both 0.61 wt % of Ca and 0.19 wt % of Y were added, the tensile strength and elongation of the cast material were increased to be slightly greater than those of the alloy in which Ca was not added and the ignition temperature thereof was 742° C., which was increased about 160° C. from that of the alloy in which Ca was not added. In addition, as presented in Table 3, comparing the tensile properties of the extruded materials of comparative example 1 and example 2, it can be appreciated that the yield strength and tensile strength of the alloy in which 0.18 wt % of Ca and 0.12 wt % of Y were added were increased but the elongation thereof were decreased from those of the alloy in which Ca was not added. Nevertheless, the extruded material of example 2 still shows a high value of elongation of about 20%.

As such, it can be appreciated that the ignition resistance of the alloy in which both Ca and Y are added is greatly improved and the tensile properties thereof are also improved from those of an alloy in which Ca is added alone.

The Mg alloy and the method of manufacturing the same according to exemplary embodiments of the present invention have been described above in detail with reference to the accompanying drawings. However, it will be apparent to a person having ordinary skilled in the art to which the present invention belongs that the foregoing embodiments are merely examples of the invention and various modifications and variations are possible. Therefore, it should be understood that the scope of the invention shall be defined only by the appended claims.

The invention claimed is:

1. A magnesium alloy manufactured by melt casting, the magnesium alloy consisting of, by weight, 7.0% or greater but less than 9.5% of Al, 0.05% to 0.58% of Ca, 0.05% to 0.4% of Y, greater than 0% but less than 1.2% of Zn, greater than 0% but not greater than 1.0% of Mn, a balance of Mg, and other unavoidable impurities, and an oxide layer including a CaO and $Y_2O_3$ layer disposed on the magnesium alloy, and a MgO and CaO layer disposed on the CaO and $Y_2O_3$ layer, wherein a total content of the Ca and the Y is equal to or greater than 0.1% but less than 0.98% of a total weight of the magnesium alloy.

2. The magnesium alloy of claim 1, wherein the total content of the Ca and the Y is equal to or greater than 0.1% but less than 0.7% of the total weight of the magnesium alloy.

* * * * *